US006973803B2

(12) United States Patent
Olive et al.

(10) Patent No.: US 6,973,803 B2
(45) Date of Patent: Dec. 13, 2005

(54) REFRIGERATOR WATER SUPPLY SYSTEMS

(76) Inventors: Bentley J. Olive, 103 Springland Ct., Cary, NC (US) 27519; LeAnne C. Olive, 103 Springland Ct., Cary, NC (US) 27519

( * ) Notice: Subject to any disclaimer, the term of this patent is extended or adjusted under 35 U.S.C. 154(b) by 0 days.

(21) Appl. No.: 10/828,714

(22) Filed: Apr. 21, 2004

(65) Prior Publication Data

US 2004/0211209 A1 Oct. 28, 2004

Related U.S. Application Data

(60) Provisional application No. 60/466,152, filed on Apr. 28, 2003.

(51) Int. Cl.[7] ..... F25C 1/00
(52) U.S. Cl. ..... 62/338; 62/340
(58) Field of Search ..... 62/338–340

(56) References Cited

U.S. PATENT DOCUMENTS

| | | | | |
|---|---|---|---|---|
| 2,027,092 A | | 1/1936 | Dowell | |
| 2,030,291 A | | 2/1936 | Fuller | |
| 2,032,722 A | | 3/1936 | Schwab | |
| 2,274,409 A | * | 2/1942 | Harbison | 222/183 |
| 2,751,757 A | | 6/1956 | Hobbs et al. | |
| 2,761,288 A | | 9/1956 | Anderson et al. | |
| 2,811,021 A | | 10/1957 | Moore | |
| 2,914,218 A | * | 11/1959 | Korodi | 222/131 |
| 3,208,641 A | | 9/1965 | Brugioni | |
| 3,511,415 A | * | 5/1970 | Crowe | 222/146.1 |
| 3,570,266 A | | 3/1971 | Alvarez et al. | |
| 3,834,178 A | * | 9/1974 | Pink | 62/338 |
| 5,083,442 A | | 1/1992 | Vlock | |
| 5,156,021 A | | 10/1992 | St-Gelais et al. | |
| 5,490,547 A | * | 2/1996 | Abadi et al. | 141/359 |
| 5,542,265 A | | 8/1996 | Rutland | |
| 5,715,699 A | * | 2/1998 | Coates et al. | 62/338 |
| 5,743,106 A | | 4/1998 | Lee | |
| 5,753,289 A | | 5/1998 | Ness | |
| 5,791,523 A | | 8/1998 | Oh | |
| 5,813,245 A | | 9/1998 | Coates et al. | |
| 5,819,547 A | * | 10/1998 | Oh | 62/188 |
| 5,907,958 A | | 6/1999 | Coates et al. | |
| 5,918,773 A | | 7/1999 | Donovan et al. | |
| 6,039,219 A | | 3/2000 | Bach et al. | |
| 6,158,305 A | | 12/2000 | Slepicka | |
| 6,349,733 B1 | | 2/2002 | Smith | |
| 6,610,339 B1 | | 8/2003 | Borgerson | |

* cited by examiner

*Primary Examiner*—William E. Tapolcai
(74) *Attorney, Agent, or Firm*—Bentley J. Olive

(57) ABSTRACT

Refrigerator Water Supply Systems. A refrigerator is provided according to the present invention. The refrigerator can include a cabinet including at least one wall and a door pivotally mounted to the at least one wall to define a refrigeration compartment. The refrigerator can also include a first water supply line extending into the cabinet and adapted to interface with a removable water supply. Further, the refrigerator can include a mount attached to the cabinet and positioned to hold the removable water supply in the refrigeration compartment for interfacing the first water supply line.

9 Claims, 11 Drawing Sheets

REFRIGERATOR WATER SUPPLY SYSTEMS

RELATED APPLICATIONS

This application claims the benefit of U.S. provisional patent application No. 60/466,152, filed Apr. 28, 2003, the disclosure of which is incorporated herein by reference in its entirety.

TECHNICAL FIELD

The present invention relates to refrigerators. More particularly, the present invention relates to refrigerator water supply systems situated for dispensing water to an automatic ice maker and/or a water dispenser.

BACKGROUND ART

Many currently available refrigerators include water dispensers and automatic ice makers. Typically, water is supplied to the water dispenser and ice maker via connection to a household water tap source such as a municipal water supply or a rural well system. In recent years, water filters have been incorporated into refrigerators for filtering the water supplied from the household water tap.

Although current refrigerators have water filters incorporated therein, the water filtered from the water tap can be unsuitable to many persons to consume. It has been widely reported that water supplied from the water tap can be unhealthy for consumption, especially in the long term. For example, the water supplied from municipal water supplies can typically contain chlorine and various other chemicals that make the water unsuitable for consumption. Furthermore, during drought conditions, municipalities often recycle used water to clean the filtration system. This "back-wash water" is then put back into the reservoir to be treated and used. The problem is that the backwash can contain microbes, such as *Giardia* and *Cryptosporidium*, which can cause sickness. Additionally, the water supplied from a rural well system can contain high amounts of certain unhealthful minerals, runoff chemicals from nearby farms, and other harmful contaminants, which cannot always be adequately filtered.

Recently, many persons have turned to consuming bottled water because it is more pure than the water available from a household water tap. Bottled water is typically stored in the refrigerator compartment of a refrigerator or on a household water cooler. In this way, the water can be conveniently used for drinking but not for making ice. Most conventional refrigerators include an automatic ice maker connected to the household water tap for supplying water to make ice. As opposed to consuming the ice made from the ice maker, many persons fill up ice cube trays with bottled water to produce ice in the freezer compartment of the refrigerator. It would be beneficial to provide a refrigerator having a water supply system that can be conveniently connected with a water supply tank or bottled water source.

Some effort has been made to integrate the water from a bottled water container into the water dispenser or ice maker of a refrigerator. U.S. Pat. No. 6,039,219 discloses one attempt to integrate a refrigerator liquid dispenser with a refillable liquid bottle. The refillable liquid bottle is attached to the inside of the refrigerator compartment door for chilling the stored liquid. The liquid bottle includes an output connected through the refrigerator compartment door to the exterior for operation by an operator to dispense liquid. The patent fails to disclose any type of integration with an automatic ice maker. It would be beneficial to provide a system for integrating a refillable liquid bottle with an ice maker.

U.S. Pat. No. 3,570,266 discloses a refrigerator having an ice maker water reservoir. The water reservoir includes an inlet for connection to an automatic ice maker. Water can be obtained from a dispenser on the water reservoir. However, it would be beneficial to provide integration of a water supply tank to the water supply system of a refrigerator.

Despite progress in the art, exemplified by the forgoing patents, there exists a need in the art for a system for integrating a removable water supply tank with an automatic ice maker and a water dispenser of a refrigerator.

DISCLOSURE OF THE INVENTION

According to one aspect of the invention, a refrigerator is provided. The refrigerator can include a cabinet including at least one wall and a door pivotally mounted to the at least one wall to define a refrigeration compartment. The refrigerator can also include a first water supply line extending into the cabinet and adapted to interface with a removable water supply. Further, the refrigerator can include a mount attached to the cabinet and positioned to hold the removable water supply in the refrigeration compartment for interfacing the first water supply line.

According to a second aspect of the invention, a refrigerator is provided. The refrigerator can include a cabinet including at least one wall and a door pivotally mounted to the at least one wall to define a refrigeration compartment. The refrigerator can also include a first water supply line extending into the cabinet and adapted to interface with a removable water supply. Additionally, the refrigerator can include a water dispenser and ice maker connected to the first water supply line for receiving water from the removable water supply. The refrigerator can also include a mount attached to the cabinet and positioned to hold the removable water supply in the refrigeration compartment for interfacing the first water supply line.

According to a third aspect of the invention, a refrigerator is provided. The refrigerator can include a cabinet including at least one wall and a door pivotally mounted to the at least one wall to define a refrigeration compartment. The refrigerator can also include a water supply mounted in the refrigeration compartment. Additionally, the refrigerator can include a first water supply line extending into the cabinet and connected to the water supply. The refrigerator can also include a water dispenser and ice maker connected to the first water supply line for receiving water from the removable water supply.

According to a fourth aspect of the invention, a removable water supply for insertion into a refrigerator cabinet having guides is provided. The removable water supply can include at least one wall forming an interior for holding water therein. The removable water supply can also include a cap adapted to interface the probe of a refrigerator for dispensing water from the interior to the refrigerator. Further, the removable water supply can include at least one contact surface connected to the at least one wall for positioning the removable water supply in the refrigerator by contacting the guides of the refrigerator.

Accordingly, it is an object of the present invention to improving the supply of water to the ice maker and water dispenser of a refrigerator.

It is another object of the present invention to provide a removable water supply for a refrigerator having connection to the ice maker and water dispenser.

Some of the objects of the invention having been stated hereinabove, other objects will become evident as the description proceeds when taken in connection with the accompanying drawings as best described hereinbelow.

BRIEF DESCRIPTION OF THE DRAWINGS

Exemplary embodiments of the invention will now be explained with reference to the accompanying drawings, of which.

DETAILED DESCRIPTION OF THE INVENTION

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
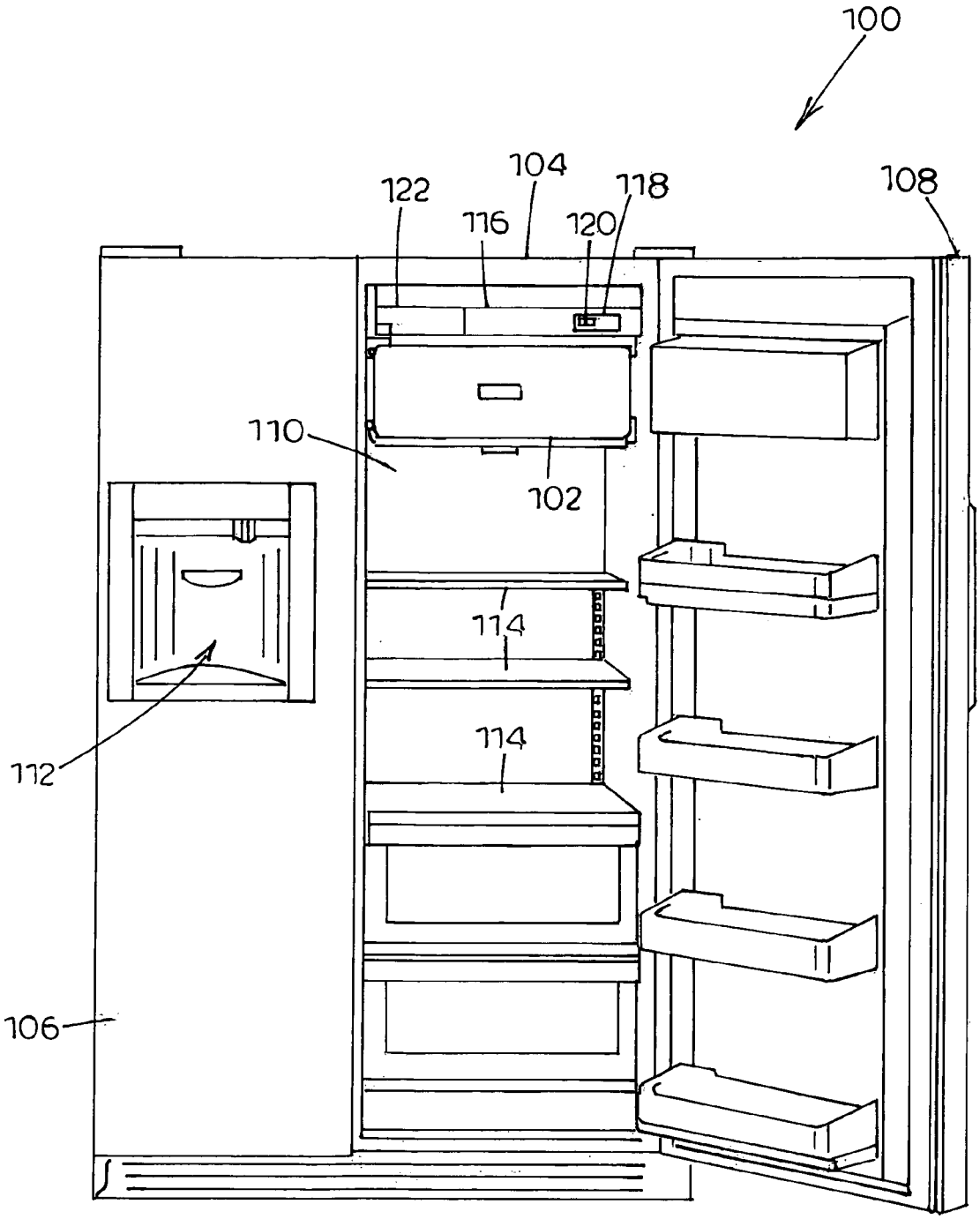
FIG. 1 is a perspective view of a refrigerator incorporating a water supply tank according to an embodiment of the present invention.

Referring to FIG. 1, a perspective view of a refrigerator, generally designated 100, incorporating a removable water supply tank 102 according to an embodiment the present invention is illustrated. Refrigerator 100 can include a cabinet 104 having a plurality of insulated walls. A freezer door 106 and a refrigerator door 108 are pivotally mounted to cabinet 104 and cooperate with cabinet 104 to define a freezer compartment (shown in FIG. 6 and described in more detail below) and a refrigeration compartment 110, respectively. The illustrated refrigerator 100 is commonly known in the art as a "side-by-side" type refrigerator because the freezer and refrigeration compartments are positioned side-by-side one another.

It is contemplated that removable water supply tank 102 and the systems described hereinbelow can be used in other types of refrigerators, such as ones wherein the freezer and refrigeration compartments are vertically offset relative to one another. Furthermore, although the following discussion is based upon incorporation of a removable water supply tank into refrigerator 100, which includes an automatic ice maker (shown in FIG. 6) and a water dispenser 112, it is considered apparent that water supply tank 102 can be used in refrigerators that do not include an automatic ice maker, and in refrigerators wherein the ice and/or water dispenser is not accessible from an exterior of the refrigerator.

As shown in FIG. 1, refrigeration compartment 110 is generally rectangular in configuration, and has a series of shelves 114 mounted therein for storage of foodstuffs. At an upper portion of refrigeration compartment 110, a panel 116 is provided to which various controls and indicators 118 for controlling and/or monitoring water supply tank 102 and/or regulating operating conditions of refrigerator 100 can be mounted. Specifically, panel 116 can include a water supply switch 120 for controlling whether water supplied to the ice maker and water dispenser 112 is made available from water supply tank 102 or the water tap, such as a well or municipal water supply. In an alternative embodiment, freezer door 106 can include an indicator for indicating a low water supply condition in water supply tank 102. Refrigerator 100 can also include a filter 122 for filtering the water supplied from the water tap.

Figure 2:
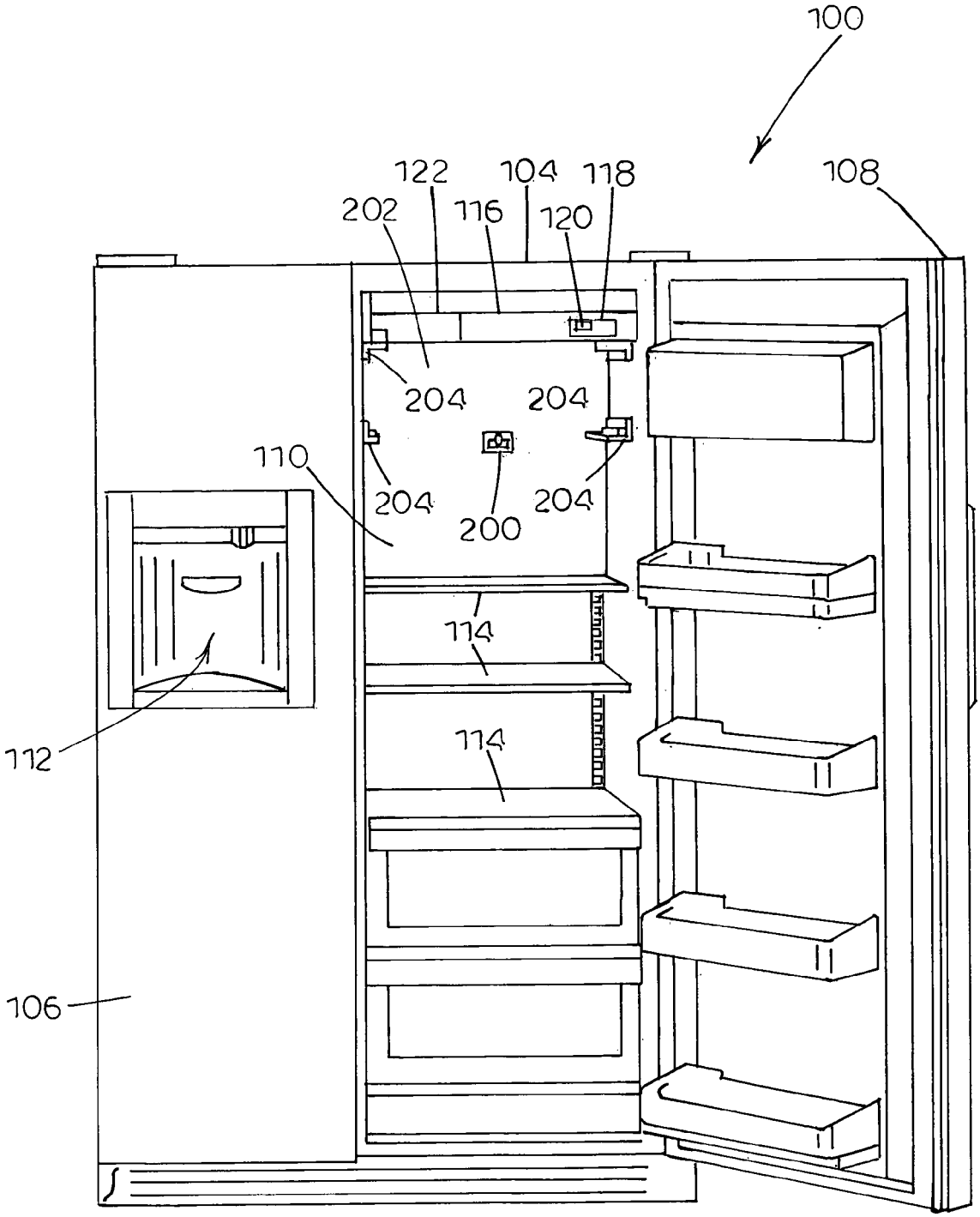
FIG. 2 is another perspective view of the refrigerator illustrated in FIG. 1 with the water supply removed.

Referring to FIG. 2, another perspective view of refrigerator 100 with water supply tank 102 (shown in FIG. 1) removed according to an embodiment of the present invention is illustrated. Refrigerator 100 includes a probe 200 connected to a back wall portion 202 of refrigeration compartment 110 for interfacing a corresponding cap (shown in FIGS. 5, 7, 8A, and 8B and described in more detail below) of water supply tank 102. As described in further detail below, probe 200 and the cap of water supply tank 102 can interface one another for the delivery of water from water supply tank 102 to the water supply system of refrigerator 100. The delivered water can then be selectively distributed to water dispenser 112 and the automatic ice maker.

Figure 3:
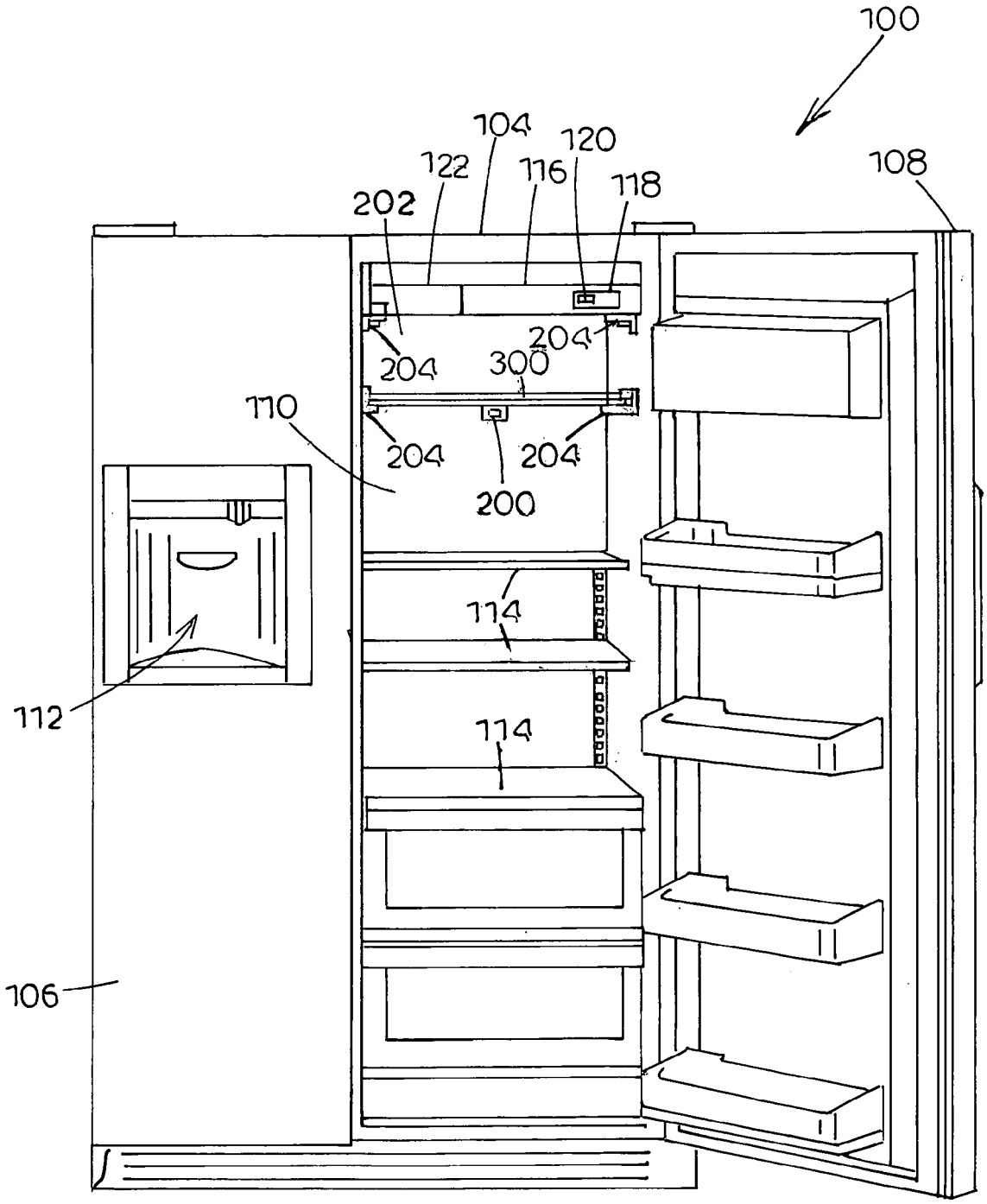
FIG. 3 is another perspective view of the refrigerator illustrated in FIG. 1 with the water supply tank removed and a removable shelf positioned on the supports of water supply tank.

Refrigerator 100 can also include a plurality of supports 204 attached to the walls of refrigeration compartment 110 for holding water supply tank 102 in refrigerator compartment 110. Supports 204 can also receive and position the cap of water supply tank 102 to interface probe 200 when water supply tank 102 is properly inserted into refrigeration compartment 110 (described in more detail below). Referring now to FIG. 3, another perspective view of refrigerator 100 with water supply tank 102 (shown in FIG. 1) removed and a removable shelf 300 positioned on supports 204 according to the present invention is illustrated. Supports 204 can hold shelf 300 for providing additional storage space for foodstuffs when water supply tank 102 is not utilized.

Figure 4:
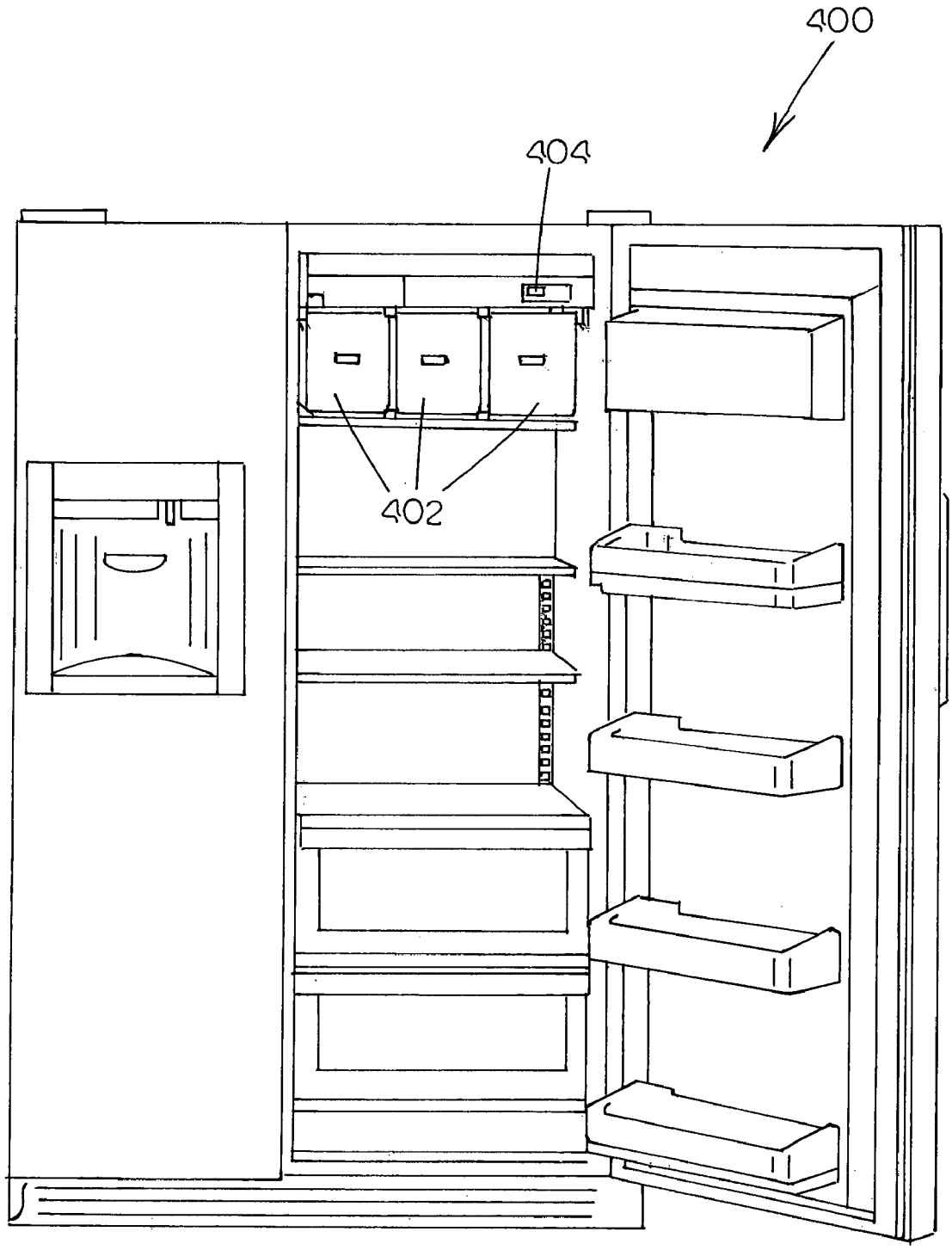
FIG. 4 is a perspective view of another embodiment of a refrigerator with a plurality of removable water supply tanks according to another embodiment of the present invention.

FIG. 4 illustrates a perspective view of a refrigerator 400 with a plurality of removable water supply tanks 402 according to another embodiment of the present invention. The utilization of a plurality of water supply tanks 402 facilitates the loading of a large amount of water into refrigerator 400 because the tanks are easier for a person to separately lift into position than lifting a single large water supply tank containing an equivalent amount of water. Refrigerator 400 can also include a plurality of probes (not shown) for interfacing the caps of water supply tanks 402. Refrigerator 400 can include controls 404 for selectively switching the sourcing of water between water supply tanks 402 to the water supply line. The selective switching between water supply tanks 402 can be useful when different types of water or other consumable liquids are stored in the water supply tanks.

Figure 5:
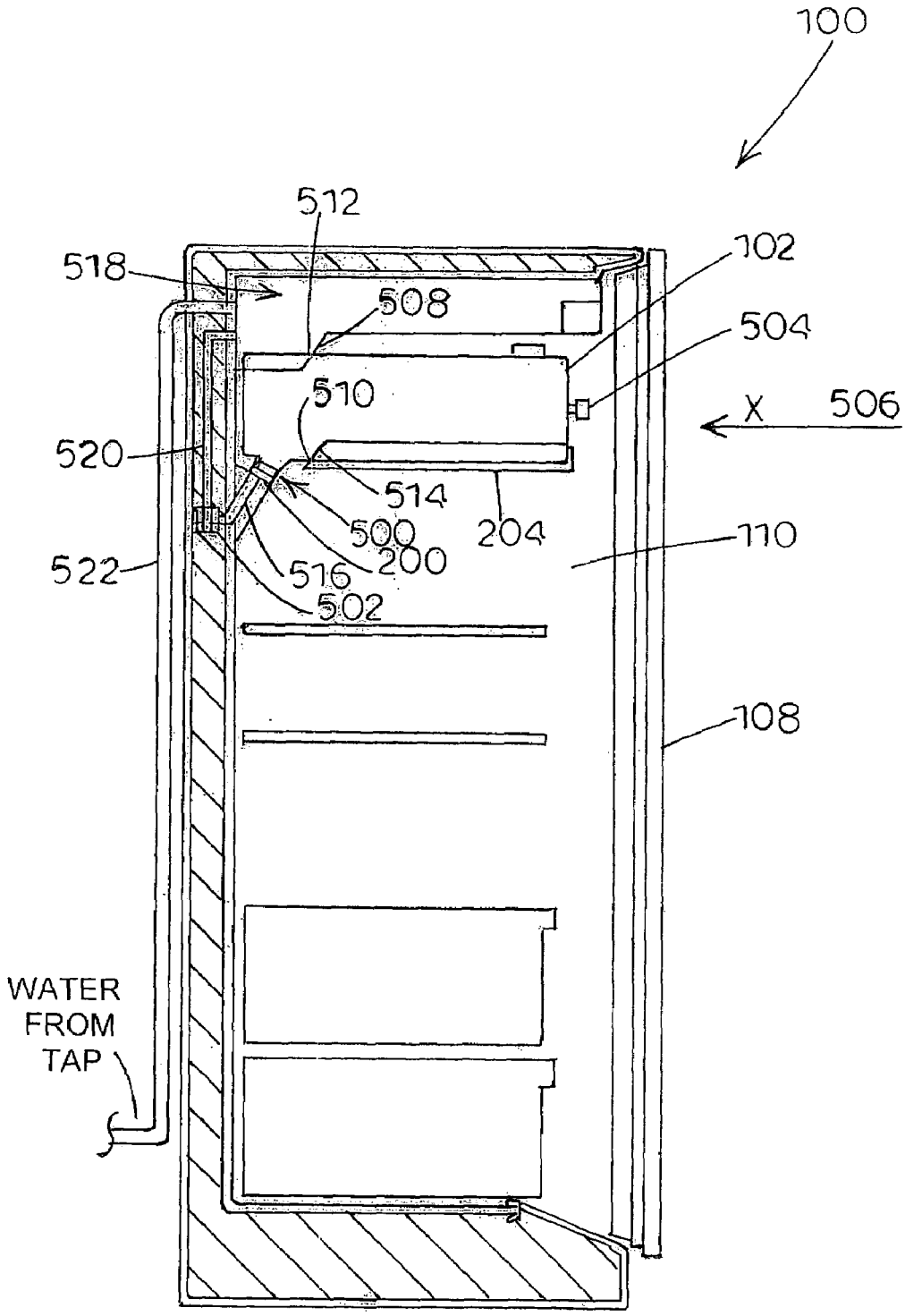
FIG. 5 is a side, cross-sectional view of the refrigeration compartment of the refrigerator illustrated in FIG. 1.

FIG. 5 illustrates a side, cross-sectional view of refrigeration compartment 110 of refrigerator 100. Water supply tank 102 is shown positioned with a cap, generally designated 500, inserted into probe 200 for dispensing water to a first control valve 502 (as described in further detail below). Water supply tank 102 can include a handle 504 for contact by an operator to push water supply tank 102 in a general direction x 506 into the shown position. During insertion, water supply tank 102 can partially rest upon and slide against supports 204. Further, when water supply tank 102 is being inserted and nears the position as shown, guides 508 and 510 contact guide contact surfaces 512 and 514 of water supply tank 102, respectively, to guide water supply tank 102 in position with cap 500 into probe 200.

When in the proper position shown in FIG. 5, cap 500 is positioned at the bottom of water supply tank 102 for draining all of the water in water supply tank 102 out through a first water supply line 516 to first control valve 502. As described in more detail below, first control valve 502 can control the flow of water to other water control components, generally designated 518, for controlling the flow of water to ice/water dispenser 112 and the ice maker. Water control components 518 are described in more detail below. Water can flow to the other water control components from first control valve 502 via a second water supply line 520. Refrigerator 100 can also include a third water supply line 522 for delivery of water from the water tap to water control components 518. Water control components 518 can control delivery of water from the water tap and water supply tank 102 to the ice maker and ice/water dispenser 112. The operation of first control valve 502 and water control components 518 are described in more detail below.

Figure 6:
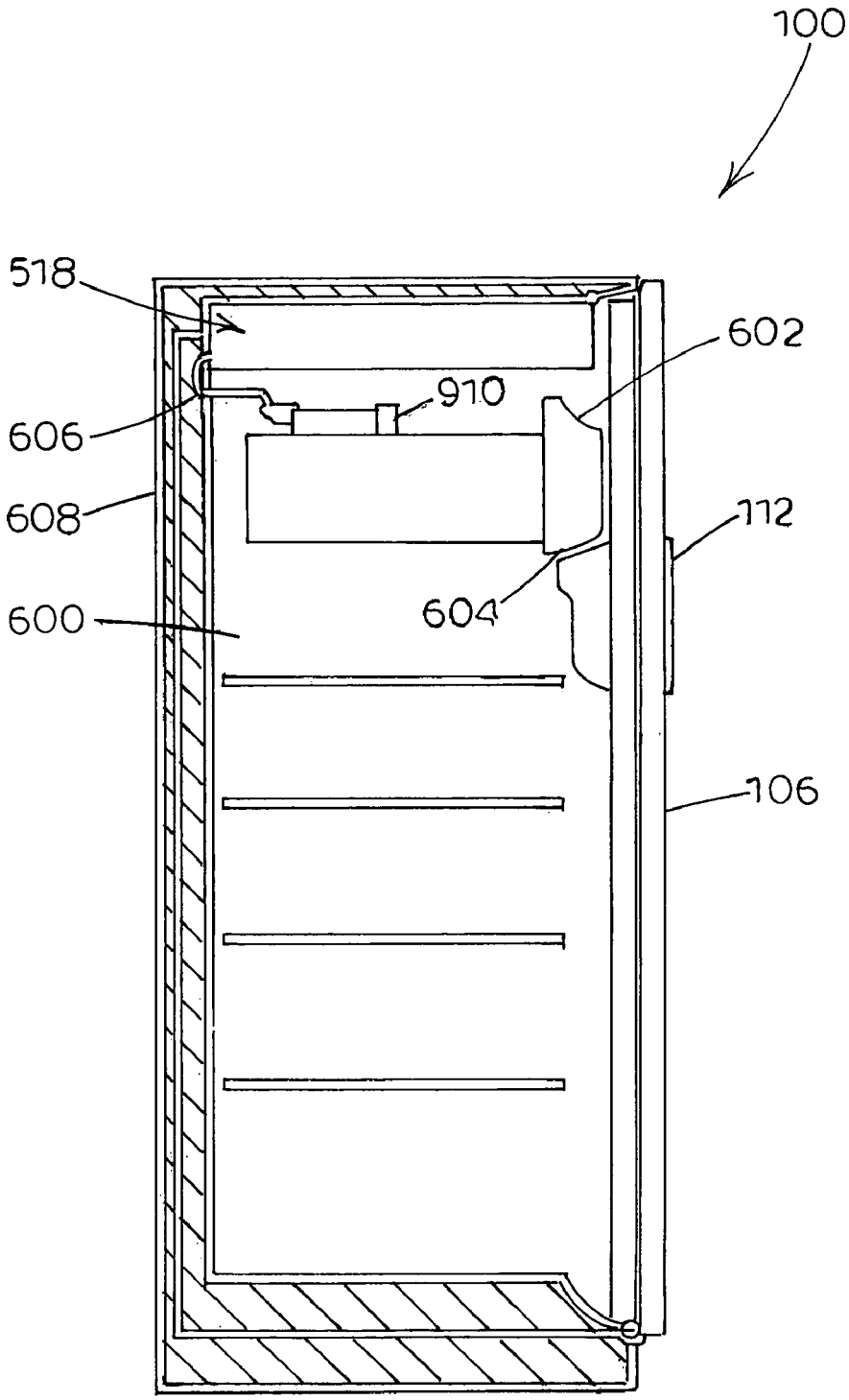
FIG. 6 is a side, cross-sectional view of the freezer compartment of the refrigerator illustrated in FIG. 1 including an ice and an ice/water dispenser.

FIG. 6 illustrates a side, cross-sectional view of a freezer compartment 600 of refrigerator 100 including an ice maker 910 (also shown in FIG. 9 and described in further detail below) and ice/water dispenser 112. Ice maker 910 can include an ice container 602 for storing ice and a dispenser 604 for delivery of ice from ice container 602 to ice/water dispenser 112. After receiving ice from ice container 602, ice/water dispenser 112 can dispense water on the exterior of refrigerator 100. Water can be delivered to ice maker 910 from water control components 518 via a fourth water supply line 606. Water can be delivered to ice/water dispenser 112 from water control components 518 via a fifth water supply line 608. Fifth water supply line 608 extends from water control components 518 around the bottom of refrigerator 100 and up the bottom of freezer door 106.

Figure 7:
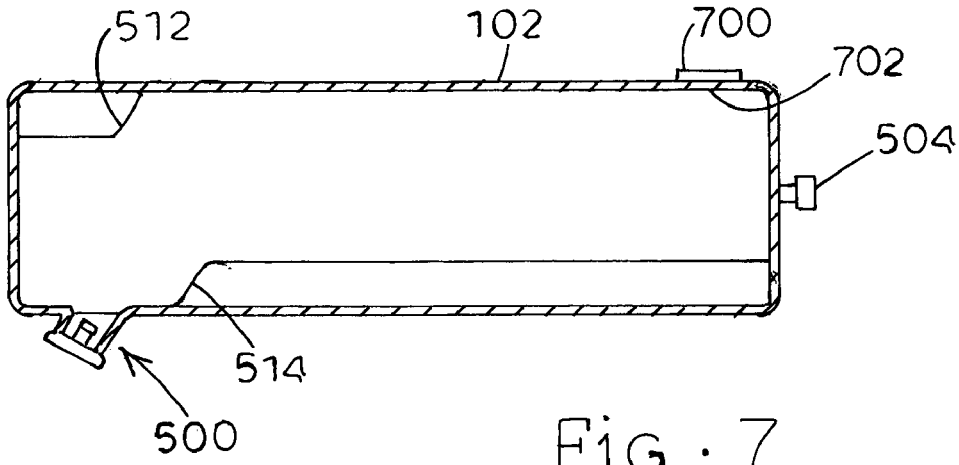
FIG. 7 is a cross-sectional view of the water supply tank of the refrigerator illustrated in FIG. 1.

FIG. 7 illustrates a cross-sectional view of water supply tank 102. Handle 504 can be used to pull water supply tank 102 in a direction generally opposing direction x 506 (shown in FIG. 5) for removing water supply tank 102 from refrigeration compartment 110. Water supply tank 102 can also include a removable cap 700 covering an opening 702 for filling water supply tank 102 with water.

Figure 8A:
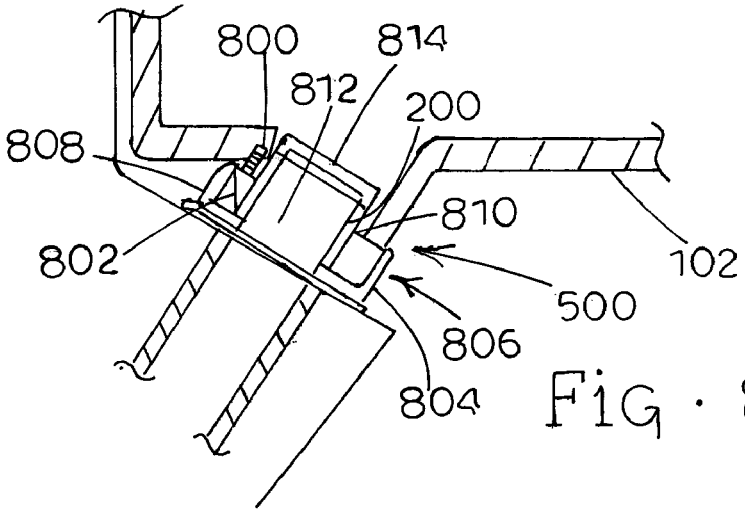
FIGS. 8A and 8B are cross-section views of a water supply tank according to an embodiment of the present invention.

Referring to FIG. 8A, a cross-sectional view of cap 500 of water supply tank 102 and probe 200. Cap 500 can include a pull tab 800, scoreline 802, snap-on ring section 804 for removal of cap 500 for refill by a water bottler, as known to those of skill in the art. Snap-on ring section 804 can include a lower lip 806 which extends around the lower circumference of snap-on ring section 804. Cap 500 can include include at least two different outside diameters, i.e., at least one diameter at snap-on ring section 804 and at least one diameter below lip 806 of snap-on ring section 804. Cap 500 can also include a relatively planar upper face 808. Formed integrally with this upper face 808 is a central dispensing tube 810. Central dispensing tube 810 has an outlet 812 through which the water may be dispensed. For the purpose of sealing cap 500 and, more specifically, central dispensing tube 810 to prevent water from being discharged before installation, a dispensing tube cap 814 can be attached to the innermost end of sealingly engaging probe 200. When inserted, probe 200 passes through outlet 812 of central dispensing tube 810, and a groove on the probe extends to the dispensing tube cap 814. When probe 200 is far enough inside the water supply tank 102, a hole in the side of probe 200 allows water to flow freely from water supply tank 102.

Figure 8B:
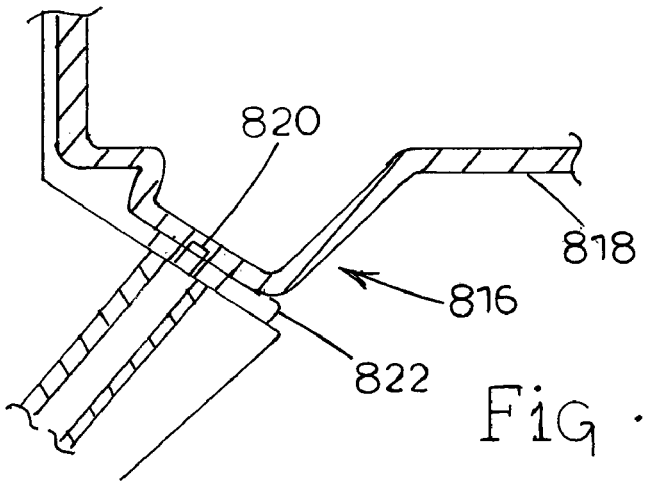

Referring to FIG. 8B, a cross-sectional view of a cap, generally designated 816, of a water supply tank 818 of another embodiment of the present invention. Cap 816 is shown connected to an insertion nozzle 820 of the refrigerator. Cap 816 can include a valve 822, as known to those of skill in the art, for release of water inside water supply tank 818 by an operator after the water supply tank 818 has been positioned in the refrigerator. After release, water can flow into the water dispensing system of the refrigerator for use by an ice maker and ice/water dispenser.

Alternatively, water supply tank 102 can be permanently attached to first water supply line 516. In this alternative, water can be refilled by access through cap 700 by an operator.

Figure 9:
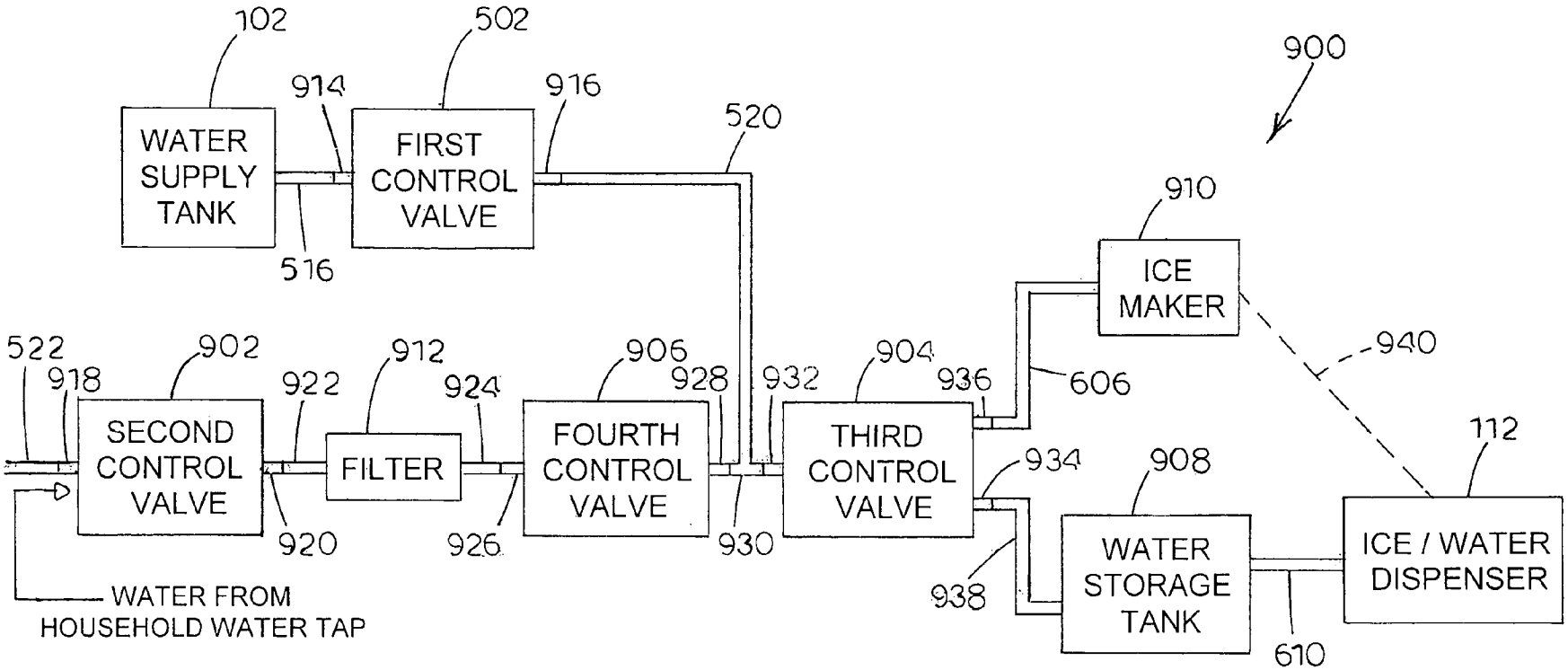
FIG. 9 is a water/ice dispensing system operable with water supply tank according to an embodiment of the present invention.

Water supply tank 102 described above is intended for use as part of a water/ice dispensing system. FIG. 9 illustrates a water/ice dispensing system, generally designated 900, operable with water supply tank 102 according to an embodiment of the present invention. Dispensing system 900 includes, in addition to the above-described water supply tank 102, first control valve 502, a second control valve 902, a third control valve 904, a fourth control valve 906, a water storage tank 908, an automatic ice maker 910, a filter 912, and combination ice/water dispenser 112.

First control valve 502 can be relatively upstream, in a direction of water flow, from third control valve 904, and controls the delivery of water from water supply tank 102 to third control valve 904. As described in more detail below, third control valve 904 can control water flow to ice maker 910 and ice/water dispenser 112. First control valve 502 has an input 914 and output 916 which is opened and closed by a solenoid 916*a* (shown in FIGS. 10A and 10B and described in more detail below).

First control valve input 914 can be connected to water supply tank 102 via first water supply line 516. In an alternative embodiment, first water supply line 516 can include a water sensor for detecting the supply of water from water supply tank 102. A low water supply condition can be indicated on the freezer door by the above-mentioned indicator. Output 916 can be connected to third control valve 904 via second water supply line 520.

Second control valve 902 can be connected to the water tap by third water supply line 522. Third water supply line 522 is connected to an input 918 of second control valve 902. Second control valve 902 has an output 920 for delivery of water from the water tap to filter 912 via a sixth water supply line 922. Output 920 is opened and closed by a solenoid 920*a* (shown in FIGS. 10A and 10B).

Filter 912 is connected to fourth control valve 906 via a seventh water supply line 924. Sixth water supply line 924 is connected to an input 926 of fourth control valve 906.

Fourth control valve 906 has an output 928 for delivery of water from filter 912 to third control valve 904 via an eighth water supply line 930. Output 928 is opened and closed by a solenoid 928*a* (shown in FIGS. 10A and 10B). Fourth control valve 906 can be closed when first control valve 502 is opened to deliver water to prevent water from flowing through fourth control valve 906 to filter 912. Conversely, when water is delivered through fourth control valve 906 from the water tap, first control valve 502 can be closed to prevent water from flowing through first water control valve to water supply tank 102.

Second water supply line 520 and eighth water supply line 930 are connected together to interface an input 932 of third control valve 904. Third control valve 904 can control the flow of water from water supply tank 102 or the water tap to ice/water dispenser 112 and ice maker 910 via first output 934 and second output 936, respectively. Outputs 934 and 936 are opened and closed by solenoids 934*a* and 936*a*, respectively (shown in FIGS. 10A and 10B and described in more detail below). First output 934 is fluidly connected to water storage tank 908 via a ninth water supply line 938. Second output 936 is connected to ice maker 910 via fourth supply line 606. In one embodiment, second output 936 of third control valve 904 includes a "flow washer" to regulate the flow of water into ice maker 910 to provide a controlled filling thereof.

An output of water storage tank 908 is connected to ice/water dispenser 112 by fourth water supply line 606. Ice maker 910 delivers ice to ice/water dispenser 112 via a chute 940. Ice/water dispenser 112 includes a water dispenser switch 112*a* (shown in FIG. 10B and described in more detail below). Ice maker 910 includes a switch 910*a* (shown in FIG. 10B and described in more detail below).

As known to those of skill in the art, water/ice dispensing system 900 can include water pumps operable to apply water pressure for causing water to flow as described above.

Figure 10A:
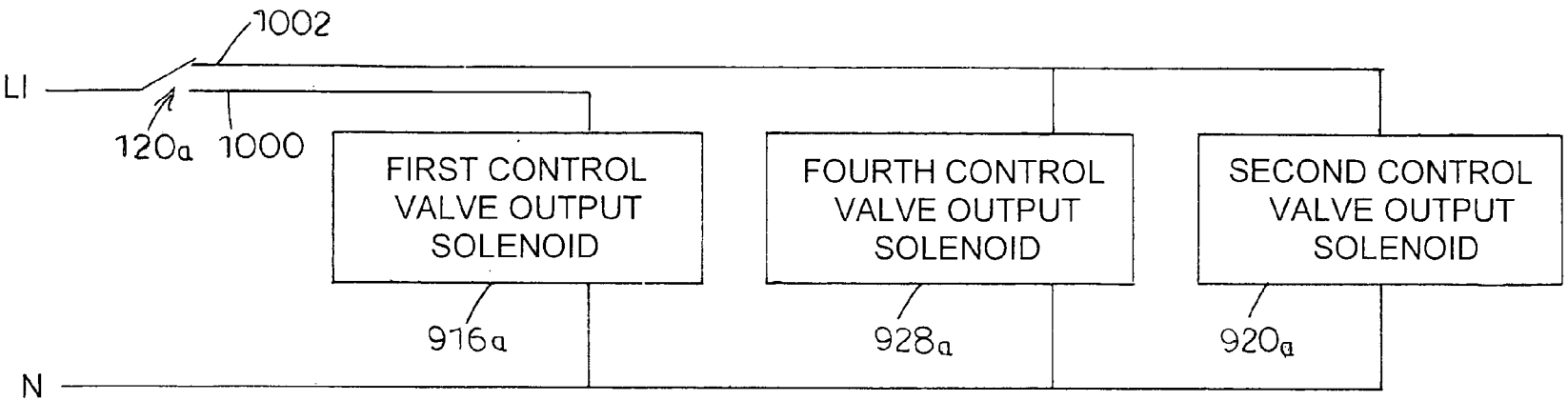
FIGS. 10A and 10B are schematic diagrams of control circuits for the water/ice dispensing system illustrated in FIG. 9 according to an embodiment of the present invention.
Figure 10B:
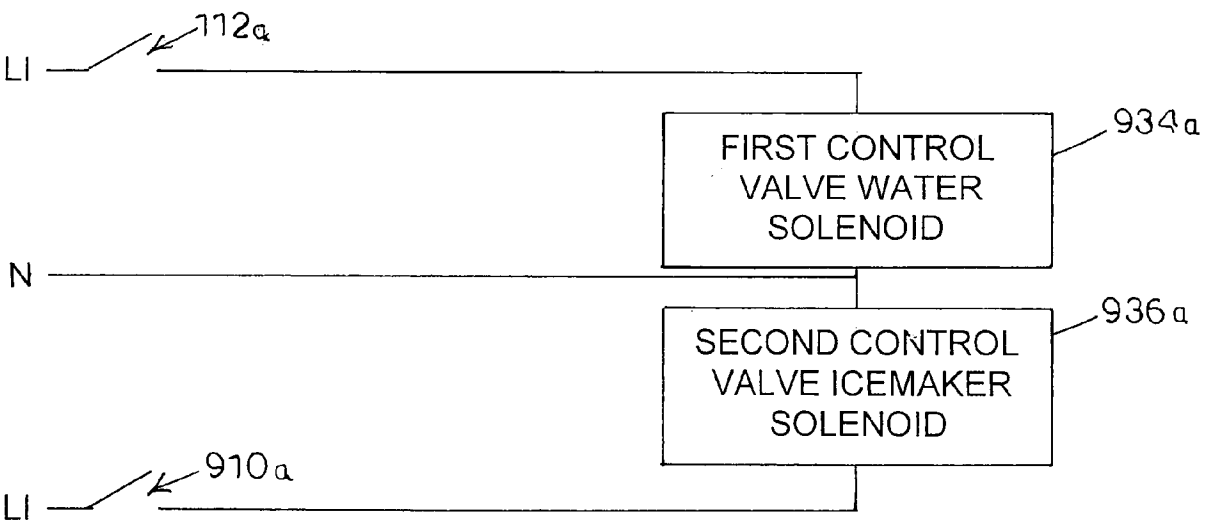

Referring to FIGS. 10A and 10B, schematic diagrams of control circuits for refrigerator 100 according to an embodiment of the present invention is illustrated. When water supply control 120 is actuated to dispense water from water supply tank 102, water supply switch 120*a* is switched to a contact 1000 to provide power to first control valve's solenoid 916*a* to open first control valve's output 916. Opening output 916 permits the flow of water from water supply tank 102 to third control valve 522, which may be controlled to permit the water to flow to either ice maker 910 or water dispenser 112.

On the other hand, when water supply control 120 is actuated to dispense water from the water tap, water supply switch 120*a* is switched to a contact 1002 to provide power to second control valve's solenoid 920*a* and fourth control valve's solenoid 928*a* to open the second control valve's output 920 and fourth control valve's output 928, respectively. Opening outputs 920 and 928 permits the flow of tap water via third water supply line 522 through filter 912 and to third control valve 904. Third control valve 904 may be controlled to permit the water to flow to either ice maker 910 or ice/water dispenser 112.

Referring now to FIG. 10B, once water from either the water tap or water supply tank 102 is available at input 932 of third control valve 904, ice/water dispenser 112 can be actuated to dispense water and automatic ice maker 910 can request water to make more ice. When ice/water dispenser 112 is actuated to dispense water, a water dispenser switch 112*a* is closed which, in turn, provides power to third control valve's first solenoid 934*a* to open the control valve's first output 934. Opening first output 934 permits the flow of water to cold water storage tank 908 and out of ice/water dispenser 112.

Similarly, when automatic ice maker 910 needs water to make more ice, ice maker switch 910*a* is closed which, in turn, provides power to the third control valve's second solenoid 936 to open the control valve's second output 936. Opening second output 936 permits the flow of water to ice maker 910.

Figure 11:
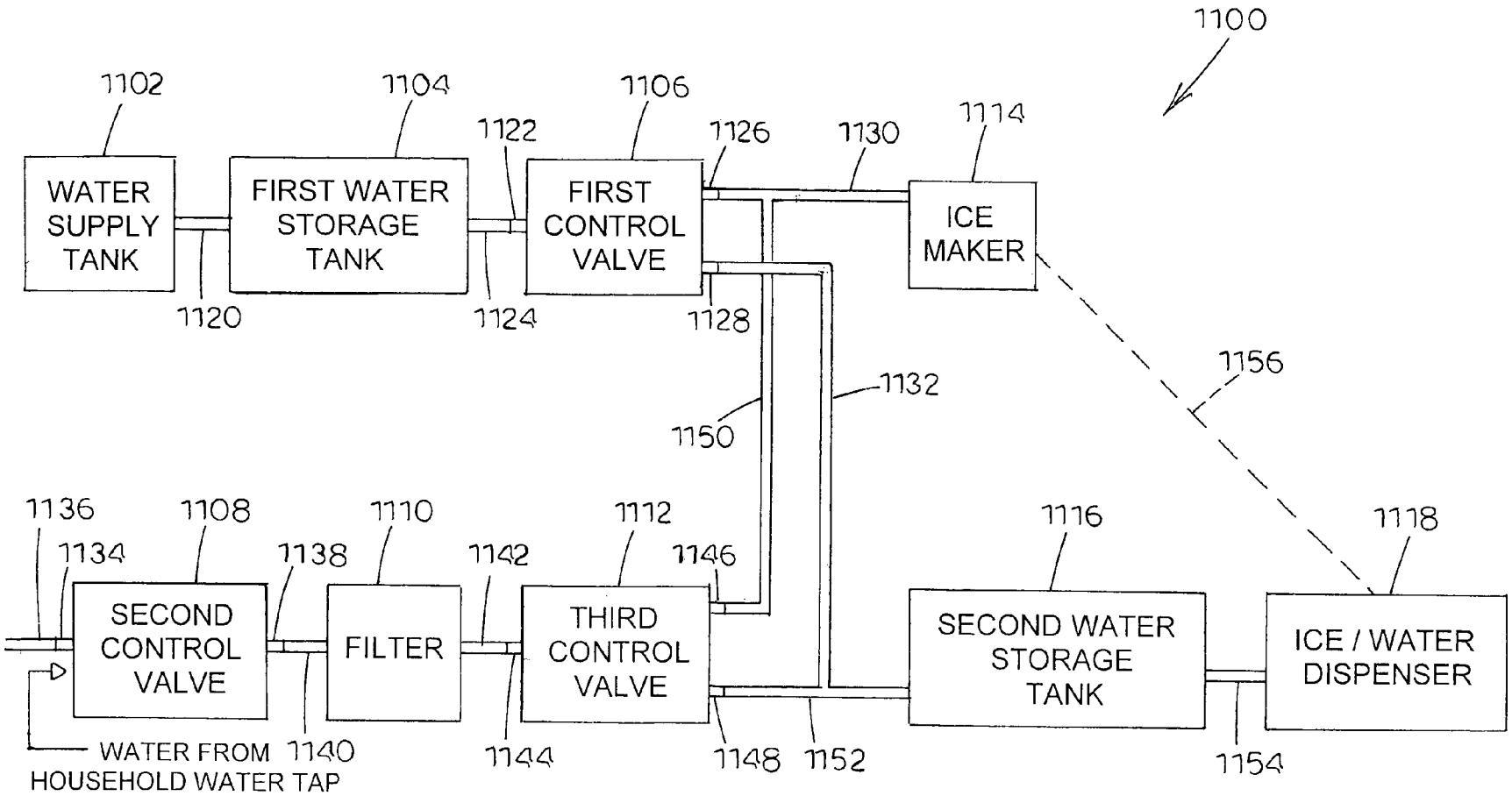
FIG. 11 is a water/ice dispensing system operable with a water supply tank according to another embodiment of the present invention.

Referring to FIG. 11, a water/ice dispensing system, generally designated 1100, operable with a water supply tank 1102 according to another embodiment of the present invention is illustrated. Dispensing system 1100 can include a first water storage tank 1104, a first control valve 1106, a second control valve 1108, a filter 1110, a third control valve 1112, an ice maker 1114, a second water storage tank 1116, and an ice/water dispenser 1118. First water storage tank 1104 can receive water from water supply tank 1102 for storing water in the refrigerator in addition to the water in water supply tank 1102. Thus, because of the additional storage, the time between refill of water supply tank 1102 can be increased. Water supply tank 1102 is connected to first water storage tank 1104 via a first water supply line 1120. In an alternative embodiment, first water storage tank 1104 can include a low water detector for detecting a low water condition and reporting the condition to an indicator. The indicator can alert an operator to a low water condition.

Water from first water storage tank 1104 flows to an input 1122 of first control valve 1106 through a second water supply line 1124. First control valve 1106 can control the flow of water from water supply tank 1102 to ice maker 1114 and ice/water dispenser 1118 via outputs 1126 and 1128, respectively. Outputs 1126 and 1128 are opened and closed by solenoids 1126*a* and 1128*a*, respectively (shown in FIG. 12 and described in more detail below). First output 1126 is fluidly connected to ice maker 1114 via a third water supply line 1130. Second output 1128 is connected to ice/water dispenser 1118 via a fourth water supply line 1132.

Water from a water tap flows to an input 1134 of second control valve 1108 through a fifth water supply line 1136. Second control valve 1108 can control the flow of water from water tap supply to filter 1110 through an output 1138 via fifth water supply line 1140. Water can flow through filter 1110 and a sixth water supply line 1142 to an input 1144 of third control valve 1112. Third control valve 1112 can control the flow of water from water tap to ice maker 1114 and ice/water dispenser 1118 via outputs 1146 and 1148, respectively. Outputs 1146 and 1148 are opened and closed by solenoids 1146*a* and 1148*a*, respectively (shown in FIG. 12 and described in more detail below). First output 1146 is fluidly connected to third water supply line 1130 via a seventh water supply line 1150 for connection to ice maker 1114. Second output 1148 is connected to fourth water supply line 1132 via an eighth water supply line 1152 for connection to ice/water dispenser 1118. Second water storage tank 1116 can be connected to ice/water dispenser 1118 via a ninth water supply line 1154. Ice maker 1114 delivers ice to ice/water dispenser 1118 via a chute 1156.

Figure 12:
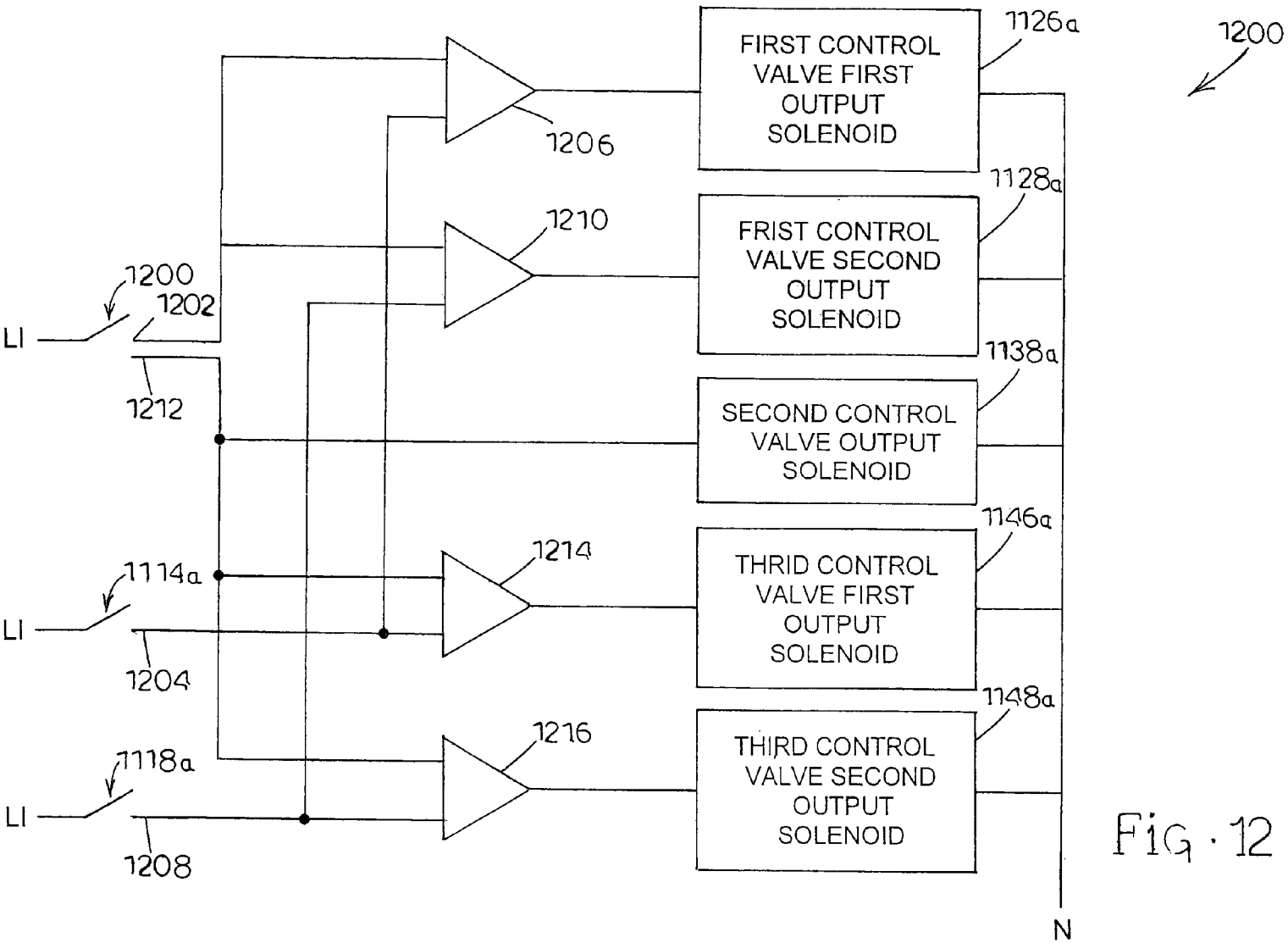
FIG. 12 is a schematic diagram of a control circuit for water/ice dispensing system illustrated in FIG. 11 according to one embodiment of the present invention.

Referring to FIG. 12, a schematic diagram of a control circuit for water/ice dispensing system 1100 according to one embodiment of the present invention is illustrated. When a water supply control on a refrigerator is actuated to dispense water from water supply tank 1102 and ice maker 1114 indicates that water is required, water supply switch 1200 is switched to a first contact 1202 and ice maker switch 1114*a* is switched to a second contact 1204, then power is provided to first control valve's solenoid 1126*a*. Opening output 1126 permits the flow of water from water supply tank 1102 to ice maker 1114. A logic AND gate 1206 is used to symbolize the condition for opening output 1126.

On the other hand, when the water supply control on the refrigerator is actuated to dispense water from water supply tank 1102 and water dispenser 1118 is actuated to dispense water, water supply switch 1200 is switched to first contact 1202 and water dispenser switch 1118*a* is switched to a third contact 1208, then power is provided to first control valve's solenoid 1128*a*. Opening output 1128 permits the flow of water from water supply tank 1102 to water dispenser 1118. A logic AND gate 1210 is used to symbolize the condition for opening output 1128.

When the water supply control on the refrigerator is actuated to dispense water from the water tap and ice maker 1114 indicates that water is required, water supply switch 1200 is switched to a fourth contact 1212 and ice maker switch 1114*a* is switched to second contact 1204, then power is provided to second control valve's solenoid 1138*a* and provided to third control valve's solenoid 1146*a*. Opening outputs 1138 and 1146 permits the flow of water from the water tap to ice maker 1114. A logic AND gate 1214 is used to symbolize the condition for opening outputs 1138 and 1146.

On the other hand, when the water supply control on the refrigerator is actuated to dispense water from the water tap and water dispenser 1118 is actuated to dispense water, water supply switch 1200 is switched to fourth contact 1212 and water dispenser switch 1118*a* is switched to third contact 1208, then power is provided to first control valve's solenoid 1128*a* and provided to third control valve's solenoid 1148*a*. Opening outputs 1128 and 1148 permits the flow of water from the water tap to water dispenser 1118. A logic AND gate 1216 is used to symbolize the condition for opening outputs 1138 and 1148.

It will be understood that various details of the invention may be changed without departing from the scope of the invention. Furthermore, the foregoing description is for the purpose of illustration only, and not for the purpose of limitation—the invention being defined by the claims.

What is claimed is:

1. A refrigerator comprising:

(a) a cabinet including at least one wall and a door pivotally mounted to the at least one wall to define a refrigeration compartment;

(b) a first water supply line extending into the cabinet and adapted to interface with a removable water supply, wherein the first water supply line is connected to a water dispenser and an ice maker for supplying water contained in the removable water supply to the water dispenser and the ice maker;

(c) a mount attached to the cabinet and positioned to hold the removable water supply in the refrigeration compartment for interfacing the first water supply line;

(d) a second water supply line adapted to interface a water tap and having connection to water dispenser and ice maker for supplying water from the water tap to the water dispenser and ice maker; and (e) at least one control valve having inputs connected to the first and second water supply lines and at least one output connected to the water dispenser and ice maker for controlling the output of water from the water tap and removable water supply to the water dispenser and ice maker.

2. The refrigerator of claim 1, wherein the first water supply line extends through a rear wall of the cabinet positioned across the refrigeration compartment from the door.

3. The refrigerator of claim 1, further including a water supply switch connected to the first control valve for selecting one of the water tap and removable water supply for output to the water dispenser and ice maker.

4. The refrigerator of claim 1, further including a water storage tank connected to the removable water supply and the first water supply for storing water from the removable water supply.

5. The refrigerator of claim 4, wherein the water storage tank is positioned in the refrigeration compartment.

6. The refrigerator of claim 1, wherein the cabinet includes at least one guide to position the removable water supply in the cabinet when the removable water supply is inserted into the cabinet.

7. The refrigerator of claim 6, further including a probe adapted to interface a cap of the removable water supply.

8. A refrigerator comprising:

(a) a cabinet including at least one wall and a door pivotally mounted to the at least one wall to define a refrigeration compartment;

(b) a first water supply line extending into the cabinet and adapted to interface with a removable water supply;

(c) a water dispenser and ice maker connected to the first water supply line for receiving water from the removable water supply;

(d) a mount attached to the cabinet and positioned to hold the removable water supply in the refrigeration compartment for interfacing the first water supply line;

(e) a second water supply line adapted to interface a water tap and having connection to the water dispenser and the ice maker for supplying water from the water tap to the water dispenser and the ice maker; and (f) at least one control valve having inputs connected to the first and second water supply lines and at least one output connected to the water dispenser and the ice maker for controlling the output of water from the water tap and removable water supply to the water dispenser and the ice maker.

9. The refrigerator of claim 8, further including a water supply switch connected to the first control valve for selecting one of the water tap and removable water supply for output to the water dispenser and ice maker.

* * * * *